United States Patent [19]

Elms

[11] 4,147,961

[45] Apr. 3, 1979

[54] ENERGY-CONSERVING SOLID-STATE-CONTROLLED ILLUMINATION SYSTEM

[75] Inventor: Robert T. Elms, Monroeville, Pa.

[73] Assignee: Westinghouse Electric Corp., Pittsburgh, Pa.

[21] Appl. No.: 861,587

[22] Filed: Dec. 19, 1977

[51] Int. Cl.[2] ..... G05F 1/00; H05B 37/02; H05B 39/04; H05B 41/36

[52] U.S. Cl. ..... 315/291; 307/141; 315/293; 315/DIG. 7

[58] Field of Search ..... 315/291, 293, 294, 297, 315/307, 360, 362, DIG. 4, DIG. 7; 307/141; 340/335

[56] References Cited

U.S. PATENT DOCUMENTS 3,885,197 5/1975 Moses ..... 315/DIG. 4

3,940,660 2/1976 Edwards ..... 315/DIG. 4

*Primary Examiner*—Alfred E. Smith
*Assistant Examiner*—Robert E. Wise
*Attorney, Agent, or Firm*—R. S. Lombard

[57] ABSTRACT

An energy-conserving solid-state-controlled illumination system which normally operates high-intensity discharge lamps at about rated power consumption with a relatively high output for a predetermined proportion of the night when a high degree of illumination is desirable. The illumination system then operates the lamps at about a predetermined power less than rated power consumption when a lower degree of illumination can be tolerated. The relative period of time the lamps are operated at the higher and lower levels of illumination is automatically adjusted according to the day-night seasonal variations.

8 Claims, 3 Drawing Figures

ENERGY-CONSERVING SOLID-STATE-CONTROLLED ILLUMINATION SYSTEM

CROSS-REFERENCE TO RELATED APPLICATION

In copending application Ser. No. 861,591, filed Dec. 19, 1977, and owned by the same assignee, is disclosed a lighting system which automatically dims the lamps after a fixed time period of operation at rated power input.

BACKGROUND OF THE INVENTION

This invention relates to control systems for vapor-discharge lamps and, more particularly, to a control system which automatically dims the lamps for the latter portion of the night when a lower degree of illumination can be tolerated.

The present system constitutes an improvement over the aforesaid cross referenced application in that it automatically compensates for variations in the length of night-time.

SUMMARY OF THE INVENTION

This invention provides an energy-conserving solid-state-controlled illumination system. This illumination system normally operates high-intensity discharge lamp means at about rated power consumption with a relatively high light output for a predetermined proportion of the first period of the night when a high degree of illumination is desirable and thereafter operates the lamp means at about a predetermined power less than rated power consumption when a lower degree of illumination can be tolerated.

The system comprises input terminal means adapted to be connected to a source of electrical energy and output terminal means adapted to be connected to the input of the lamp means. Lamp ballasting means are provided in circuit with the lamp means between the input terminal means and the output terminal means. The lamp ballasting means has a first operating mode in which about average rated power is delivered to the input of the lamp means to cause the lamp means to operate at about rated power consumption. The lamp ballasting means also has a second operating mode in which the average power delivered to the input of the lamp means is a predetermined amount less than the power consumption at which the lamp means is rated.

The system also includes main switching means which has an open nonconductive state and a closed conductive state. The switching means is connected in circuit with the input terminal means and the lamp ballasting means. The switching means closes during the night and energizes the lamp means and opens and de-energizes the lamp means during the day when there is sufficient light. A controlled switching means is operable to place the ballasting means in the first operating mode or in the second operating mode.

The system also includes timing and signal generating means responsive to the darkening closing of the main switching means and to the daylight opening of the main switching means to measure the actual time the main switching means is in the closed state during the night and to generate an output signal representative of the actual period of time the main switching means is in the closed state. There is also provided memory and time-related control signal means connected to the output of the timing means for recording the generated output signal. The memory and time-related control signal means is responsive to the next darkening closing of the main switching means to generate a time-related control signal after a time period which represents a predetermined proportion of the actual length of time represented by the recorded timing means signal. The output of the time-related control signal means is connected to the controlled switching means to place the ballasting means in the second mode for the remainder of the nighttime the lamp means is energized.

BRIEF DESCRIPTION OF THE DRAWINGS

For a better understanding of the invention, reference may be had to the exemplary embodiment shown in the accompanying drawings in which.

DESCRIPTION OF THE PREFERRED EMBODIMENTS

Figure 1:
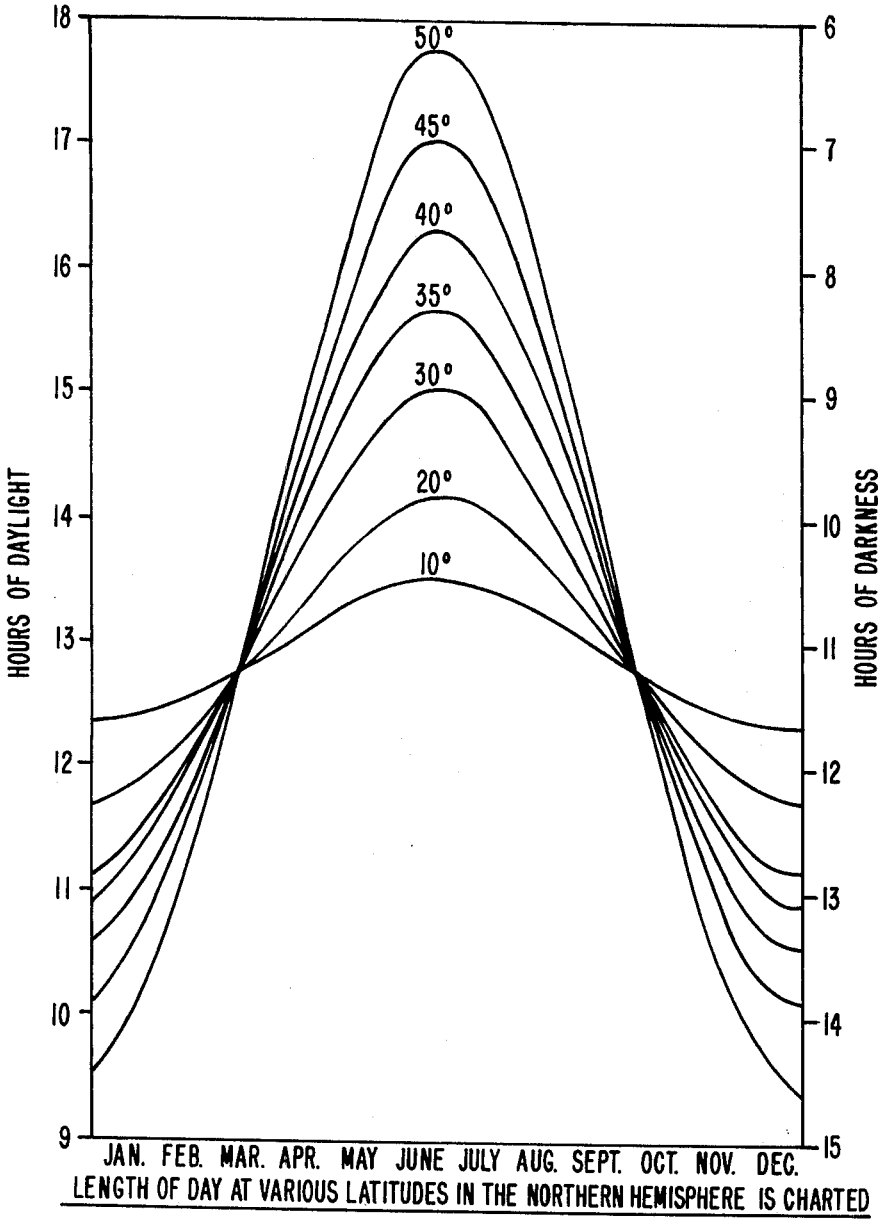
FIG. 1 is a graph of the length of day at various latitudes in the northern hemisphere.

There is provided an energy-conserving solid-state-controlled illumination system responsive to the previous night's operation. Referring to the graph in FIG. 1 it can be seen that the yearly variations in the length of night can vary by a factor of two, depending on latitude. A desirable feature of an energy-conserving illumination system is to make the delay time before dimming responsive to the number of hours of night operation.

The present invention as described measures the previous night's operating time and then operates at full power for a length of time equal to about one-half the previous night's total operating time. This procedure consistently puts the transition from full power operation to operating at a predetermined power less than full power at about midnight, independent of temperature or time of year.

Figure 2:
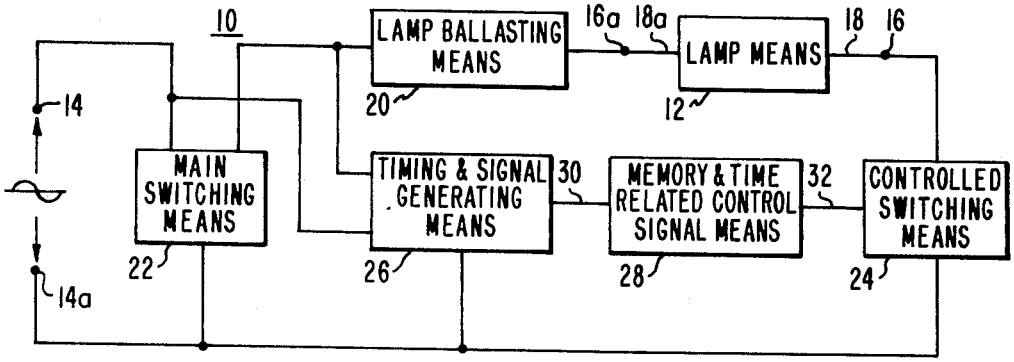
FIG. 2 is a block diagram of a preferred circuit.
Figure 3:
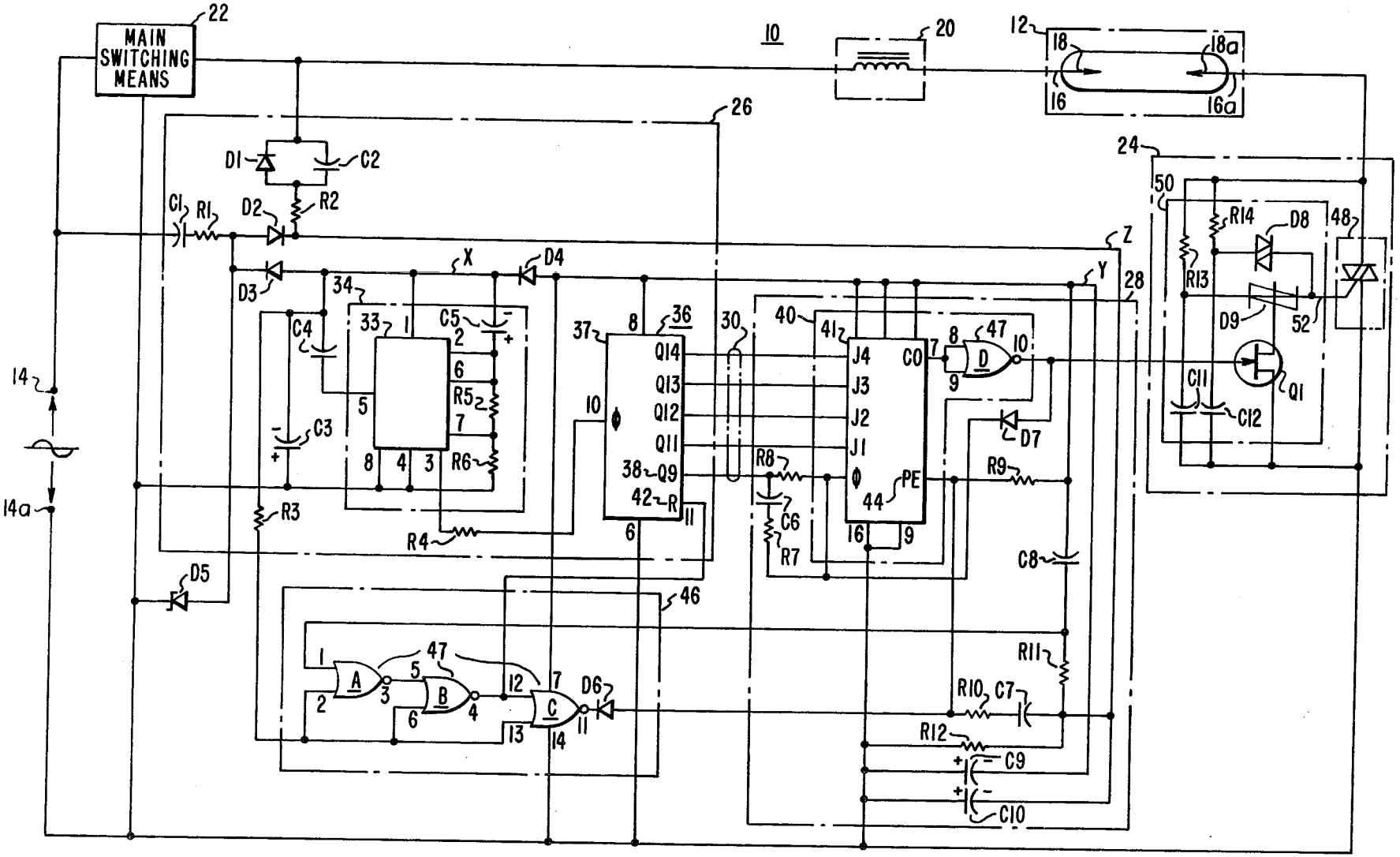
FIG. 3 is a schematic diagram of a preferred circuit in accordance with this invention.

Referring to FIGS. 2 and 3, there is shown an energy-conserving solid-state-controlled illumination system 10 which normally operates high-intensity discharge lamp means 12. The high-intensity discharge lamp means may be, for example, a high-pressure mercury vapor or sodium vapor lamp. The system 10 operates the lamp means 12 at about rated power consumption with a relatively high light output for a predetermined proportion of the first period of night when a high degree of illumination is desirable and thereafter operates the lamp means 12 at about a predetermined power less than rated power consumption when a lower degree of illumination can be tolerated.

The system 10 comprises input terminal means 14, **14*a* adapted to be connected to a source of electrical energy. Output terminal means 16, 16*a* are adapted to be connected to the input 18, 18*a* of the lamp means 12. Lamp ballasting means 20 is in circuit with the lamp means 12 between one of the input terminals 14 and one of the output terminals 16. The lamp ballasting means 20 has a first operating mode in which about average rated power is delivered to the input 18, 18*a* of the lamp means 12 to cause the same to operate at about rated power consumption. The lamp ballasting means 20 also has a second operating mode in which the average power delivered to the input 18, 18*a* of the lamp means 12 is a predetermined amount less than the power consumption at which the lamp 12** is rated.

The system 10 also includes main switching means 22 having an open nonconductive state and a closed conductive state. The switching means 22 may be a photo control circuit, for example, or a manual type switch which controls a bank of lamps. The switching means 22 is connected in circuit with the input terminal means 14, 14a and the lamp ballasting means 20 to close during the night and energize the lamp means 12 and to open and de-energize the lamp means 12 during the day when there is sufficient light. A controlled switching means 24 is operable to place the ballasting means 20 in the first mode or the second mode.

The system 10 also includes timing and signal generating means 26 responsive to the darkening closing of the main switching means 22 to measure the actual time the main switching means 22 is in a closed state during the night and to generate an output signal representative of the actual period of time the main switching means 22 is in the closed state. Memory and time-related control signal means 28 are connected to the output 30 of the timing means 26 for recording the generated output signal. The memory and time-related control signal means 28 is responsive to the next darkening closing of the main switching means to generate the time-related control signal after a time period which represents a predetermined proportion, such as fifty percent, of the actual length of time represented by the recorded timing means signal. The output 32 of the time-related control signal means is connected to the control switching means 24 to place the ballasting means 20 in the second mode for the remainder of the nighttime period the lamp means 12 is energized.

Referring to the circuit diagram shown in FIG. 3, the timing and signal generating means 26 preferably comprises first oscillator means 34 for generating timed pulses after the closing of the main switching means 22 and first digital counter and signal generating means 36 for counting the number of timed pulses generated by the first oscillator means 34 when the main switching means 22 is in the closed state during the night. The first digital counter and signal generating means 36 also generates the output signal representative of the actual period of time the main switching means 22 is in the closed state.

The memory and time-related control signal means 28 preferably comprises second oscillator means 38 for generating timed pulses after the closing of the main switching means 22 and second digital counter means 40 connected to the output 30 of the first digital counter means 36 for recording the generated output signal. The second digital counter means 40 is responsive to the next darkening closing of the main switching means 22 to generate the aforementioned time-related control signal after the second digital counter 40 has counted a total number of timed pulses from the second oscillator means 38 representing the predetermined proportion of the actual length of time represented by the recorded timing means signal. The output 32 of the second digital counter means 40 is connected to the controlled switching means 24 to place the ballasting means 20 in the second mode for the remainder of the nighttime the lamp means 12 is energized upon the generation of the time-related control signal.

The first digital counter means 36 also preferably comprises reset means 42 for resetting the first digital counter means 36 to a predetermined number at which the count should start. The second digital counter means 40 also preferably comprises preset means 44 for recording the generated output signal of the first digital counter means 36.

The illumination system 10 also preferably comprises count control means 46 for causing the reset means 42 of the first digital counter 36 and the preset means 44 of the second digital counter means 40 to be activated upon predetermined time periods of energy interruption to the lamp means 12.

The controlled switching means 24 preferably comprises solid-state gate-controlled switching means 48 and gate-control means 50 responsive to the time-related control signal generated by the memory and time-related control signal means 28 and having an output 52 connected to the gate of the gate-controlled switching means 48 to control the mode of the ballasting means 20.

The following Table of components specifies typical values for use in the circuit shown in FIG. 3.

TABLE

| Component | Value | |
|---|---|---|
| C1 | .15μ f | 6000 |
| C2 | .0001μ f | 1KV Ceramic |
| C3 | 47μ f | 15V Solid Tantalum |
| C4 | .01μ f | 50V |
| C5 | 10μ f | 15V Solid Tantalum |
| C6 | .02μ f | 50V |
| C7 | .33μ f | 50V |
| C8 | .47μ f | 50V |
| C9 | 10μ f | 15V Solid Tantalum |
| C10 | 10μ f | 15V Solid Tantalum |
| C11 | .047μ f | 50V |
| C12 | .047μ f | 50V |
| D1 | IN5397 | |
| D2 | IN457 | |
| D3 | IN457 | |
| D4 | IN457 | |
| D5 | IN961 | |
| D6 | IN457 | |
| D7 | IN457 | |
| D8 | GT40 | Electronic Control Corporation (E.C.C.) DIAC |
| D9 | MBS4991 | Motorola |
| 33 | LM555CN | National Semiconductor Co., I.C. |
| 37 | CD4020AE | RCA, I.C. |
| 41 | CD4029AE | RCA. I.C. |
| 47 | CD4001AE | RCA, I.C., includes NOR gates labeled A, B, C and D |
| 48 | Q5010 | E.C.C. TRIAC |
| Q1 | 2N4222 | |
| R1 | 24 Ω | ½W |
| R2 | 47K | 2W |
| R3 | 100K | ¼W |
| R4 | 10K ¼W | |
| R5 | 1K | ¼W |
| R6 | 620K | ¼W |
| R7 | 47K | ¼W |
| R8 | 1M | ¼W |
| R9 | 2M | ¼W |
| R10 | 1K | ¼W |
| R11 | 2M | ¼W |
| R12 | 10K | ¼W |
| R13 | 100K | 178 W |
| R14 | selected | ½W |
| 22 | Photocontrol 240V input | |
| 20 | Lag Type Ballast for 240V input | |
| 12 | High Intensity Discharge Lamp, 400 Watt Hg | |

Referring to FIG. 3 the operation of the circuit is as follows:

Three power supplies are provided to the circuit from the 240 volt line. The first of these supplies is labeled "X" and is approximately −9.5 volts because of the zener D5. The second power supply is labeled "Y" and at that point in the circuit the voltage is approximately −9 volts because of the drop through diode D4. The third power supply is labeled "Z" and provides a voltage of approximately −10.5 volts at the junction of capacitors C10 and C7. The first oscillator means 34 is composed of a timer 33 which provides approximately one timed pulse every 3 seconds for feeding the first digital counter means 36. The timer 33, as indicated previously, is a commercial item. The other components of the first oscillator means 34 function as follows: C4 provides noise filtering and the timing function is developed by C5 and R6 which cooperate with the timer 33 to set the oscillator rate. C3 functions as a power supply filter and R3 serves as a current limiter. The output of the first oscillator means 34 is developed at pin designated "3" of the timer 33 and flows through current limiting resistor R4 to the first digital counter and signal generating means 36 which is composed of 14-state digital counter 37 in this embodiment. Digital counter 37 is also a commercial item and is readily available. Each stage of counter 37 counts half the number of inputs into it. Digital counter 37 has four outputs, labeled Q11, Q12, Q13 and Q14. These four outputs generate an output signal in binary form representative of the actual period of time the main switching means 22 is in the closed state. Output Q14, for example, represents the first digital counter 36 receiving about 16,000 timed pulses from the first oscillator means 34 or $2^{14}$ pulses. A binary signal of "1" appearing at the Q11 output corresponds to the lamp means 12 operating for one hour, a "1" at Q12 corresponds to an operation of two hours, a "1" at Q13 corresponds to an operation of four hours and a "1" at Q14 corresponds to eight hours operation. A binary output signal with "four 1's" appearing at Q11–Q14 represents a total lamp 12 operating time of 15 hours. This generated binary output signal is fed into the second digital counter 40 which as shown includes a 4-stage presettable up/down binary counter 41, which is also a commercial item, and part of integrated circuit 47, labeled "D".

When power is removed from the lamp means 12 by the opening of the main switching means 22, which in this embodiment is a photocontrol circuit and power is removed by the onset of daylight, the Z power supply which originates at the halfwave rectifier D1, C2 and R2 and which is applied across C10 will go from a voltage of about −10.5 volts to 0 volts. When the voltage at C10 goes to 0 which in this circuit is equivalent to a logic state of "1", this logic "1" is applied via C7 and R10 to the terminal labeled "PE" which is the preset means 44 located on the up/down binary counter 41. A "1" at the "PE" terminal causes the binary counter 41 to record the binary output signal from the digital counter 37 outputs Q11–Q14. This binary signal input is impressed on the terminals J1–J4 of the binary counter 41 and is stored by counter 41 until the next night's operation. Before the lamp means 12 is de-energized by the main switching means 22, the voltage across C8 is approximately 0 volts and therefore, the voltage at the juncture of C8 and R11 will be approximately at the "Z" power supply level which is equivalent to a logic state of "0". This logic "0" is fed into the terminal labeled 1 of NOR gate A which is part of the count control means 46. The other input labeled 2 of NOR gate A is determined by the X power supply which is at a logic "0" or voltage of about −9.5 volts, as stated previously. With two logic "0" signals at the input of A, the output of A will be "1". A "1" going to the input of NOR gate B causes the output of B to be "0" and the reset means 42 labeled "R" on the digital counter 37 remains unactivated. Also, a logic "0" at both inputs of NOR gate C causes a "1" at the output of C which reverse biases D6 and no logic signals can flow beyond this point. After the lamp means 12 turns off, as already mentioned, the power supply Z goes positive causing C8 to charge positively through R11, but there is a delay associated with this which is generated by R11 and C8. However, when C8 reaches approximately one-half the initial Z power supply voltage it causes an effective logic "1" to be applied to the 1 input of NOR gate A. This causes the reset means 42 to reset the first digital counter 38 to 0 and at the same instance preset 44 is turned off. When the lamp means 12 is energized the next night by the main switching means 22, C8 is at a logic level of "1" initially and starts charging to a logic "0". This causes the logic "0" to appear at the 1 input of gate A which causes the reset 42 to be turned off, and D6 is again reversed biased. The status of the preset 44 is then determined by the voltage at the Z power supply which is now −10.5 volts or a logic "0" and the preset 44 remains unactivated.

The binary counter 41 in the next night's operation utilizes the stored binary signal at the inputs J1–J4 as a starting number at which it begins counting down to 0. The countdown of binary counter 41 is keyed by the second oscillator means 38 which in this embodiment is the Q9 output of digital counter 37. The Q9 output generates one timed pulse about every 15 minutes. Thus, the Q11 output of the counter 37 represents to the binary counter 41 a half hour instead of one hour. Q12 instead of two hours represents one hour, and so on. The second digital counter 40 therefore counts twice as fast as the first digital counter 36, so digital counter 40 counts to zero in one-half the time it took first digital counter 36 to count the time the lamp means 12 was on the night before.

When the second digital counter 40, composed of binary counter 41 and inverter D, counts down to zero, it generates the time-related control signal to the gate-control means 50. Before the generation of the time-related control signal, R13 in combination with C11 and D9 control the current flow through the gate-controlled switching means 48 which causes the ballasting means 20 to be in the first operating mode and the lamp means 12 operates at about rated power. For example, for a 400 watt Hg lamp, the lamp would operate at about 400 watts. Upon the time-related control signal being generated, Q1 becomes conductive, causing D9 to become non-conductive, thereby allowing C12, R14 and D8 to take over controlling the current flow through gate controlled switch 48 which causes the ballasting means 20 to be in the second operating mode or dim mode. A 400 watt Hg lamp in the second mode operates at about 250 watts.

When the time-related control signal is generated by the second digital counter means 40, it is also fed back through D7 to prohibit any further time pulses from the second oscillator means 38 effecting the zero count condition of the second digital counter 40, and so the count remains at zero. C6, R7 and R8 are used so that the timed pulses from the second oscillator means 38 are well coupled into the second digital counter 40, but can still be disabled by the time-related control signal going through D7.

SPECIAL FEATURES FOR SHORT POWER FAILURES

For a short duration power failure (less than about 30 seconds) the logic signals from the X and Z power supplies go positive to a logic "1". However, the Y power supply logic level remains at a logic "0" until it is discharged. The circuit is designed so that in a short power failure, Y does not discharge. Therefore, a logic "1" from the X power supply causes a "1" to be applied to one of the inputs of NOR gates A, B and C. Under this condition the outputs of all those will be a logic "0"; thus a logic "0" is applied to the reset 42 and to the preset 44. Therefore during short power failures neither the first digital counter 36 nor the second digital counter 40 are changed.

SPECIAL FEATURES WITH RESPECT TO LONG POWER FAILURES

For long power failures (longer than about 30 seconds), all three power supplies X, Y and Z discharge to 0 volts for a logic level of "1". When this occurs, all memories normally are lost. The circuit is so designed, however, that when power comes up the signal to the preset 44 will be at a low state, allowing random data to appear in the second digital counter 40 so that the ballasting means will not initially be in the second operating mode or dim mode. In this case, one night's operation may be somewhat "off schedule" following the night of the long power failure, but the troubles to be encountered are minimal. The signal that causes the reset 42 to reset the first digital counter 36, is applied from R11 and C8. When power is reapplied, if the main switching means 22 is in an open or non-conductive state, the Z power supply will remain at 0 volts or a logic level of "1", and a "1" signal will be coupled into the junction of C8 and R11 which causes the reset 42 to reset the first digital counter 36 to 0. If the main switching means 22 is in a closed or conductive state when power is reapplied, all three power supplies will charge negatively. However the time constants of the X and Z power supplies are chosen so that X will come up more rapidly than Z, thus energizing the circuit and leaving the voltage of the Z power supply at zero or a logic level of "1". With a "1" at Z, C8 will charge positively towards a logic level of "1" and this causes the first digital counter 36 to reset to zero. Thereafter, Z will charge negatively towards a logic level of "0" and this "0" signal will propagate through C8 thereby cancelling the signal to the reset 42 of the first digital counter 36.

The remaining elements of the circuit function as follows:

C1 is the current limiting impedance for the X and Y power supplies along with R1. R3 is the current limit for the input signal to the logic element for the X power supply. C9 is the power supply filter for the power supply Y. R10 is merely for current limiting. C10 is the power supply filter for power supply Z and R12 is used to provide the regulated discharge time of the Z power supply. R9 is a 2 megaohm resistor which pulls the reset 44 down to the Y power supply level which normally maintains the preset 44 in a disabled condition. R5 is used to discharge C5 and provide current limiting for the pin "7" discharge output of the timer.

I claim:

1. An energy-conserving solid-state-controlled illumination system which normally operates high-intensity discharge lamp means at about rated power consumption with a relatively high light output for a predetermined proportion of the first period of the night when a high degree of illumination is desirable and thereafter operates said lamp means at about a predetermined power less than rated power consumption when a lower degree of illumination can be tolerated, said system comprising:

(a) input terminal means adapted to be connected to a source of electrical energy, and output terminal means adapted to be connected to the input of said lamp means;

(b) lamp ballasting means in circuit with said lamp means between said input terminal means and said output terminal means, said lamp ballasting means having a first operating mode in which about average rated power is delivered to the input of said lamp means to cause same to operate at about rated power consumption, and said lamp ballasting means having a second operating mode in which the average power delivered to the input of said lamp means is a predetermined amount less than the power consumption at which said lamp means is rated;

(c) main switching means having an open nonconductive state and a closed conductive state, said switching means connected in circuit with said input terminal means and said lamp ballasting means to close during the night and energize said lamp means and to open and de-energize said lamp means during the day when there is sufficient light;

(d) controlled switching means, the controlled opening and closing of which places said ballasting means in said first mode or said second mode;

(e) timing and signal generating means responsive to the closing of said main switching means and to the opening of said main switching means to measure the actual time said main switching means is in said closed state during the night and to generate an output signal representative of the actual period of time said main switching means is in said closed state, memory and time-related control signal means connected to the output of said timing means for recording said generated output signal, and said memory and time-related signal means responsive to the next closing of said main switching means to generate a time-related control signal after a time period which represents a predetermined proportion of the actual length of time represented by said recorded timing means signal, and the output of said time-related control signal means connected to said controlled switching means to place said ballasting means in said second mode for the remainder of the nighttime period said lamp means is energized.

2. The illumination system of claim 1, wherein said timing and signal generating means comprises first oscillator means for generating timed pulses after the closing of said main switching means, first digital counter means for counting the number of timed pulses generated by said first oscillator means when said main switching means is in said closed state during the night, and said first digital counter means generating said output signal representative of the actual period of time said main switching means is in said closed state.

3. The illumination system of claim 2, wherein said memory and time-related control signal means comprises second oscillator means for generating timed pulses after the closing of said main switching means, second digital counter means connected to the output of said first digital counter means for recording said generated output signal, and said second digital counter means responsive to the next darkening closing of said main switching means to generate said time-related control signal after said second digital counter has counted a total number of timed pulses from said second oscillator means representing said predetermined proportion of the actual length of time represented by said recorded timing means signal, and the output of said second digital counter means connected to said controlled switching means to place said ballasting means in said second mode for the remainder of the nighttime said lamp means is energized.

4. The illumination system of claim 3, wherein said first digital counter means comprises reset means for resetting said first digital counter means to a predetermined number at which said count should start.

5. The illumination system of claim 4, wherein said second digital counter means comprises preset means for recording said generated output signal.

6. The illumination system of claim 4, wherein said system further comprises count control means for causing said reset means of said first digital counter means and said preset means of said second digital counter means to be activated upon predetermined time periods of energy interruption to said lamp means.

7. The illumination system of claim 1, wherein said controlled switching means comprises solid-state gate-controlled switching means.

8. The illumination system of claim 7, wherein said controlled switching means further comprises gate control means responsive to said time-related control signal means and having an output connected to the gate of said gate-controlled switching means to control the mode of said gate-controlled switching means to control the mode of said ballasting means.

* * * * *